US012441564B2

(12) United States Patent
Nguyen

(10) Patent No.: US 12,441,564 B2
(45) Date of Patent: Oct. 14, 2025

(54) IMAGE FORMING APPARATUS

(71) Applicant: KYOCERA Document Solutions Inc., Osaka (JP)

(72) Inventor: Hoang Viet Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 188 days.

(21) Appl. No.: 18/517,907

(22) Filed: Nov. 22, 2023

(65) Prior Publication Data

US 2024/0174465 A1 May 30, 2024

(30) Foreign Application Priority Data

Nov. 24, 2022 (JP) ..... 2022-187481

(51) Int. Cl.
*B65H 1/26* (2006.01)
*B65H 1/08* (2006.01)

(52) U.S. Cl.
CPC ..... *B65H 1/08* (2013.01); *B65H 1/266* (2013.01); *B65H 2402/60* (2013.01)

(58) Field of Classification Search
CPC . B65H 1/08; B65H 1/26; B65H 1/266; B65H 2402/60
USPC ..... 271/162, 164
See application file for complete search history.

(56) References Cited

U.S. PATENT DOCUMENTS

| | | | | |
|---|---|---|---|---|
| 4,265,442 A * | 5/1981 | Cormier | B65H 1/12 271/170 |
| 5,078,380 A * | 1/1992 | Kitazawa | B65H 1/14 271/155 |
| 9,233,807 B2 * | 1/2016 | Lo | B65H 1/08 |
| 10,364,108 B2 | 7/2019 | Daigo | |
| 2019/0002220 A1 | 1/2019 | Daigo | |

FOREIGN PATENT DOCUMENTS

| | | | |
|---|---|---|---|
| JP | 2019011155 A | | 1/2019 |
| JP | 2022128768 A | * | 9/2022 |

* cited by examiner

*Primary Examiner* — Leslie A Nicholson, III
(74) *Attorney, Agent, or Firm* — Studebaker Brackett PLLC

(57) ABSTRACT

An image forming apparatus includes an attachment part and a sheet feeding cassette attached to the attachment part. The sheet feeding cassette includes a cassette main body, a lift plate, a lock member and a biasing member. The lift plate is supported in a turnable manner. The lock member is movable between a lock position where a turning of the lift plate is restricted and a release position where the turning of the lift plate is permitted. The biasing member biases the lock member to the lock position. In a state where the sheet feeding cassette is not attached to the attachment part, the lock member is biased by the biasing member to be positioned at the lock position. In a state where the sheet feeding cassette is attached to the attachment part, the lock member is movable either to the lock position or the release position by hand.

5 Claims, 10 Drawing Sheets

IMAGE FORMING APPARATUS

INCORPORATION BY REFERENCE

This application is based on and claims the benefit of priority from Japanese patent application No. 2022-187481 filed on Nov. 24, 2022, which is incorporated by reference in its entirety.

BACKGROUND

The present invention relates to an image forming apparatus provided with a sheet feeding cassette detachably attached to a cassette housing part.

The image forming apparatus is provided with a sheet feeding cassette in which a sheet on which an image is to be formed is stored. The sheet feeding cassette includes a cassette main body and a lift plate which is disposed on the bottom plate of the cassette main body and on which the sheet is placed. The sheet feeding cassette is detachably attached to a cassette housing part provided in the apparatus main body. In the cassette housing part, a sheet feeding device which feeds the sheet from the sheet feeding cassette is provided.

The sheet feeding cassettes may include a sheet placement plate (corresponding to the lift plate) whose upstream end portion in the attachment direction of the sheet feeding cassette is turnably supported by the cassette main body. When the sheet is placed, the sheet placement plate is turned to the lowered position where it overlaps the bottom plate of the cassette main body. When the sheet is fed by the sheet feeding device, the sheet placement plate is tuned to the lifted position where the downstream end portion of the placed sheet in the attachment direction can be fed by the sheet feeding device.

In the sheet feeding cassette described above, the upward turning of the sheet placement plate is restricted in a state where when the sheet is placed on the sheet placement plate, but the upward turning of the sheet placement plate (the downstream end portion in the attachment direction) is not restricted in a state where the sheet is not placed on the sheet placement plate. Therefore, when the sheet placement plate is turned freely without the sheet being placed, such as when the sheet is replenished to the sheet feeding cassette or when the image forming apparatus is shipped or transported, failures such as noise generated by the contact between the sheet placement plate and the cassette main body, and damage to the sheet placement plate itself and the members contacted by the sheet placement plate lift plate may occur.

For this reason, the sheet placement plate is locked to the cassette main body with an adhesive tape or the like so that it could not be turned. However, when the adhesive tape is used, there is a problem that the adhesive of the adhesive tape remains on the cassette main body after the adhesive tape is removed.

SUMMARY

An image forming apparatus according to the present disclosure includes an attachment part; and a sheet feeding cassette which is attached to the attachment part in a predetermined attachment direction. The attachment part includes a sheet feeding device which feeds a sheet from the sheet feeding cassette. The sheet feeding cassette includes a cassette main body, a lift plate, a lock member and a biasing member. The cassette main body stores the sheet. The lift plate is supported by the cassette main body in a turnable manner between a lowered position where the sheet can be placed and a lifted position where a downstream end portion of the placed sheet in the attachment direction can be fed by the sheet feeding device. The lock member is movable between a lock position where a turning of the lift plate with respect to the cassette main body is restricted and a release position where the turning of the lift plate is permitted. The biasing member biases the lock member to the lock position. In a state where the sheet feeding cassette is not attached to the attachment part, the lock member is biased by the biasing member to be positioned at the lock position. In a state where the sheet feeding cassette is attached to the attachment part, the lock member is movable either to the lock position or the release position by hand.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus and a sheet feeding cassette according to one embodiment of the present invention will be described.

Figure 1:
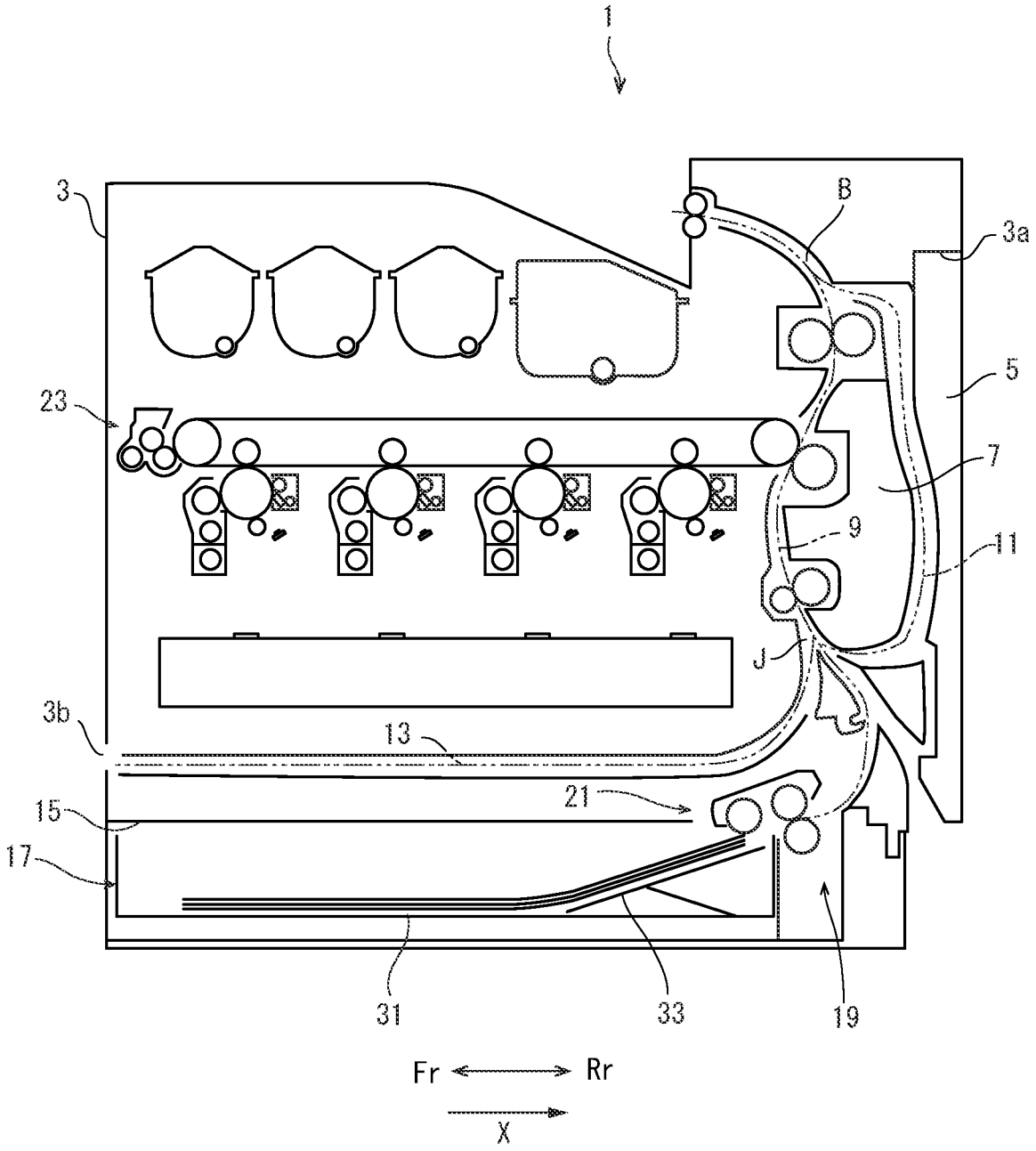
FIG. 1 is a side view schematically showing an inner structure of an image forming apparatus according to one embodiment of the present disclosure.

First, with reference to FIG. 1, the entire structure of the image forming apparatus 1 according to this embodiment will be described. FIG. 1 is a side view schematically showing the internal structure of the image forming apparatus 1. In the following description, the left side of the paper plane on which FIG. 1 is drawn is defined as the front side of the image forming apparatus 1. Fr, Rr, L, R, U and D in each figure indicate the front, rear, left, right, upper and lower sides of the image forming apparatus 1, respectively.

The apparatus main body 3 of the image forming apparatus 1 is provided with a rear cover 5 which opens and closes an opening 3*a* provided on the rear surface and a conveying unit 7 arranged inside the rear cover 5. The rear cover 5 and the conveying unit 7 are supported by the apparatus main body 3 so as to be pivoted around their lower ends. A main conveyance path 9 is formed between the apparatus main body 3 and the conveying unit 7. An inversion conveyance path 11 is formed between the conveying unit 7 and the rear cover 5. When the rear cover 5 is turned downward, the inversion conveyance path 11 is opened, and when the conveying unit 7 is turned downward together with the rear cover 5, the main conveyance path 9 is opened.

The sheet is conveyed along the main conveyance path 9 in the conveyance direction from the lower side to the upper side. The inversion conveyance path 11 is branched at a downstream branch point B on the main conveyance path 9 and is merged at an upstream junction point J on the main conveyance path 9. Furthermore, a manual sheet feeding path 13 is formed in the apparatus main body 3. The manual sheet feeding path 13 is formed almost horizontally from a manual sheet feeding port 3*b* formed on the front surface of the apparatus main body 3 toward the junction point J, and is merged with the main conveyance path 9 at the junction point J.

In the apparatus main body 3, a cassette housing part 15 is provided below the manual sheet feeding path 13. The cassette housing part 15 opens to a part of the front and the lower surfaces of the apparatus main body 3. A sheet feeding cassette 17 is detachably housed in the cassette housing part 15. The cassette housing part 15 is provided with an attachment part 19 to which the sheet feeding cassette 17 is attached and a sheet feeding device 21 which feeds the sheets from the sheet feeding cassette 17 attached to the attachment part 19 to the main conveyance path 9. The sheet feeding cassette 17 is inserted into the cassette housing part 15 through the opening in the front surface and attached to the attachment part 19. The direction in which the sheet feeding cassette 17 is inserted into the cassette housing part 15 (a direction from the front side to the rear side) is defined as an attachment direction X. In addition, a direction intersecting the attachment direction X (the left-and-right direction) is defined as a width direction W.

In the apparatus main body 3, an image forming part 23 is provided above the manual sheet feeding path 13. The image forming part 23 forms an image on the sheet by, for example, an electrophotographic method. The sheet fed by the sheet feeding device 21 from the sheet feeding cassette 17 attached to the attachment part 19 or the sheet conveyed along the manual sheet feeding path 13 is conveyed along the main conveyance path 9, and an image is formed on the sheet in the image forming part 23.

Figure 2:
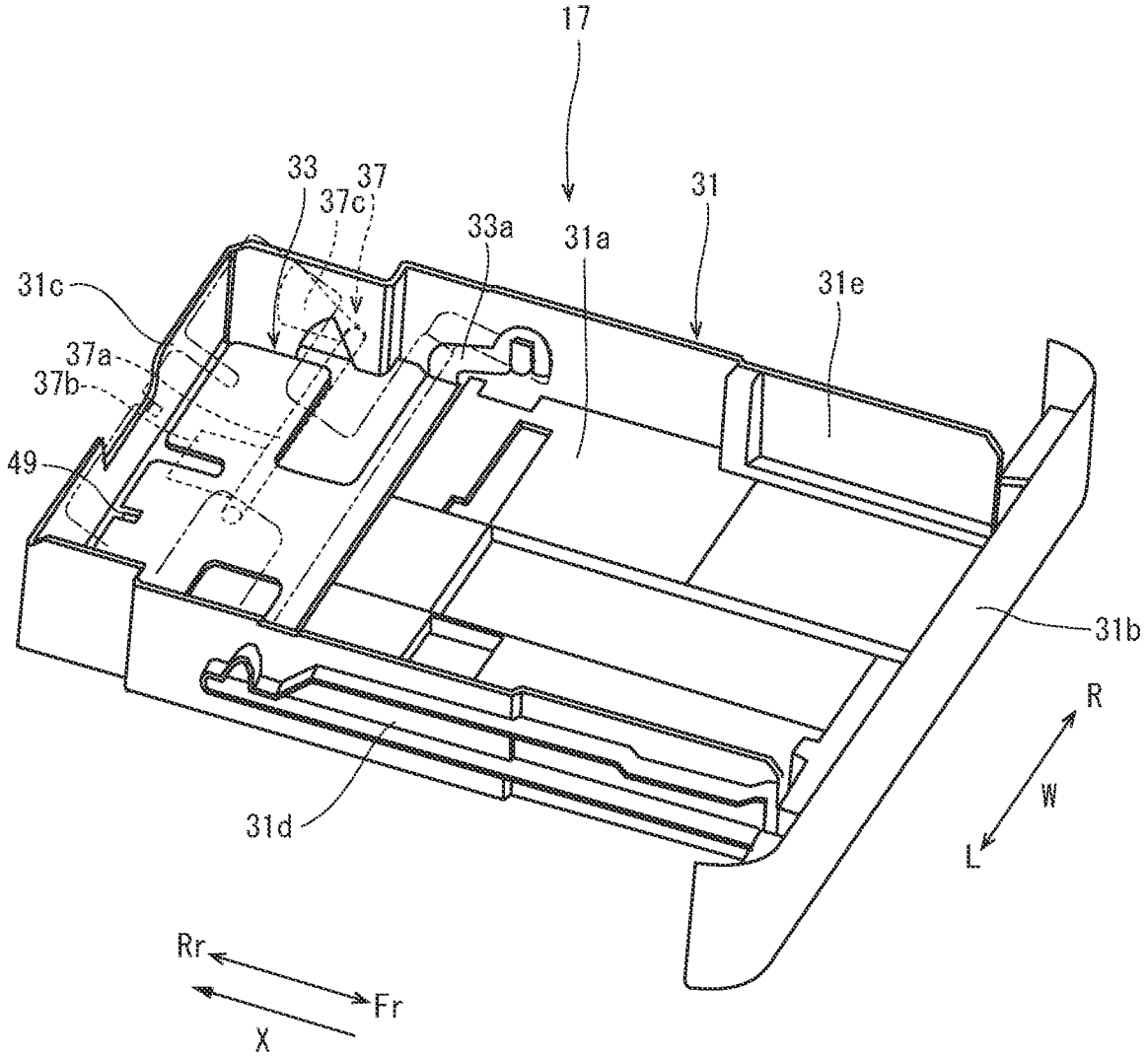
FIG. 2 is a perspective view showing a sheet feeding cassette provided in the image forming apparatus according to the embodiment of the present disclosure.
Figure 3A:
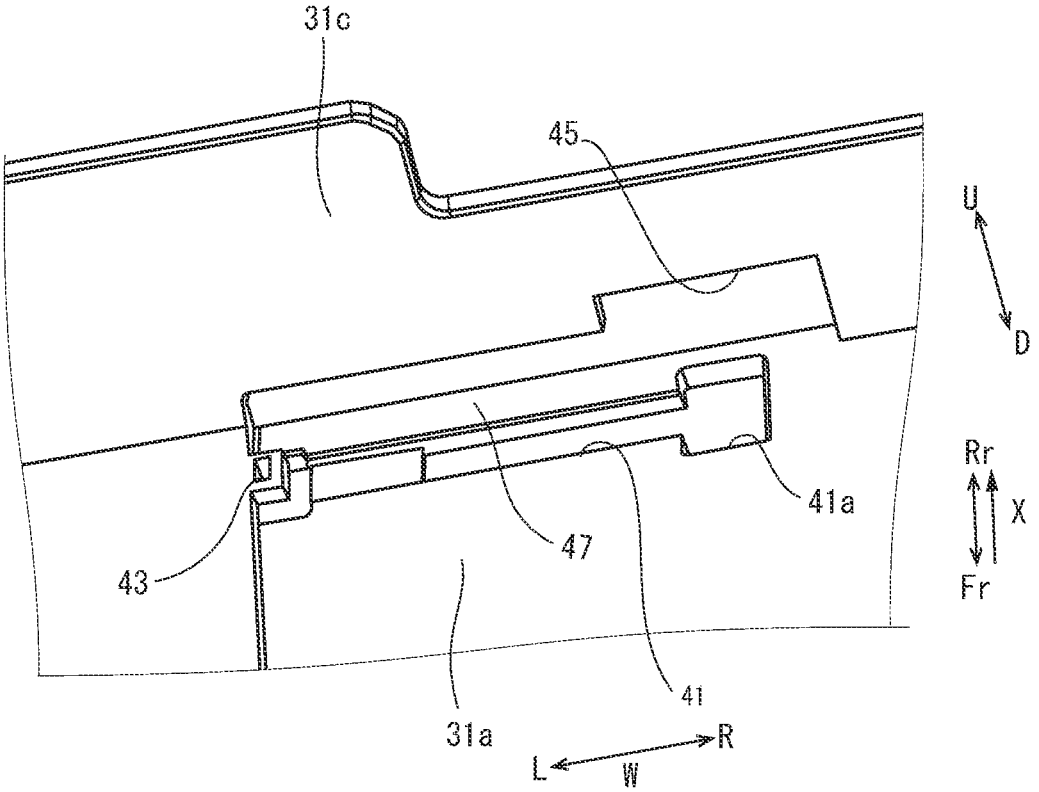
FIG. 3A is a perspective view showing a part of a cassette man body of the sheet feeding cassette provided in the image forming apparatus according to the embodiment of the present disclosure.
Figure 3B:
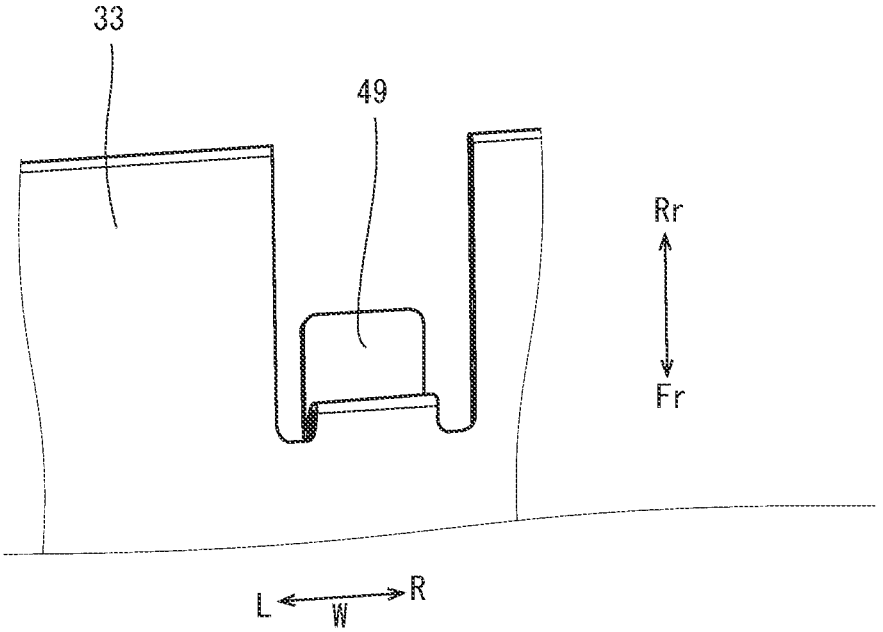
FIG. 3B is a perspective view showing a part of a lift plate of the sheet feeding cassette provided in the image forming apparatus according to the embodiment of the present disclosure.

Next, with reference to FIG. 2 to FIG. 3B, the sheet feeding cassette 17 will be described. FIG. 2 is a perspective view showing the sheet feeding cassette 17, FIG. 3A is a perspective view showing the bottom plate 31*a* and the rear side plate 31*c* of the cassette main body 31, and FIG. 3B is a perspective view showing the locked piece 49 of the lift plate 33.

As shown in FIG. 2, the sheet feeding cassette 17 includes a cassette main body 31 in which the sheets are stored, a lift plate 33 on which the sheets are placed and which is rotatably supported by the cassette main body 31, a lock member 35 (not shown in FIG. 4, see FIG. 4, FIG. 5A and FIG. 5B) movably supported by the cassette main body 31, and a lift mechanism 37 (shown by the dotted line in FIG. 2) which lifts the lift plate 33.

First, the cassette main body 31 will be described. As shown in FIG. 2, the cassette main body 31 is formed in a shallow box shape with the upper surface opened, and has a bottom plate 31*a*, front and rear side plates 31*b*, 31*c* facing each other in the attachment direction X, and left and right side plates 31*d*, 31*e* facing each other in the width direction W. As shown in FIG. 3A, the bottom plate 31*a* has a guide slit 41 along the width direction W at the downstream end portion in the attachment direction X. A wide portion 41*a* is formed at the right end portion of the guide slit 41. A hook 43 is provided on the left edge of the guide slit 41. Furthermore, the rear side plate 31*c* has an opening 45 along the width direction W at the lower end portion adjacent to the guide slit 41. The approximately right half of the opening 45 is formed higher than the left half. Thus, a rail part 47 along the width direction W is formed between the guide slit 41 and the opening 45.

Next, the lift plate 33 will be described. As shown in FIG. 2, the lift plate 33 is a rectangular plate-like member whose length along the attachment direction X is shorter than that of the bottom plate 31*a*. Right and left support pieces 33*a* bent upward are provided at the upstream end portions of the left and right side edges of the lift plate 33 in the attachment direction X. The left and right support pieces 33*a* are turnably supported by the left and right side plates 31*d*, 31*e* of the cassette main body 31.

The lift mechanism 37 is disposed below the lift plate 33. The lift mechanism 37 includes a rotational shaft 37*a*, a coupling gear 37*b* and an arm plate 37*c*. The rotational shaft 37*a* is supported rotatably by the cassette main body 31, and has one end portion protruding outside the right side plate 31*e* of the cassette main body 31 and the other end positioned below the lift plate 33. The coupling gear 37*b* is fixed to the protruded end portion of the rotational shaft 37*a*. The arm plate 37*c* is fixed to the other end of the rotational shaft 37*a*. When the sheet feeding cassette 17 is attached to the attachment part 19, the coupling gear 37*b* is meshed with a driving gear (not shown) provided on the attachment part 19. By the driving of the driving gear, the arm plate 37*c* is turned via the coupling gear 37*b* and the rotational shaft 37*a* to abut on the lower surface of the lift plate 33, and pushes up the lift plate 33. Thus, the lift plate 33 can be turned between the lowered position (see the solid line in FIG. 2) and the lifted position (see the two-dotted chain line in FIG. 2). In the lowered position, the lift plate 33 is turned so as to overlap the upper surface of the bottom plate 31*a*, and the downstream end portions of the sheets in the attachment direction X is placed on the lift plate 33. In the lifted position, the downstream end portion of the lift plate 33 in the attachment direction X is lifted, and the downstream end portions of the placed sheets in the attachment direction X can be fed by the sheet feeding device 21 (see FIG. 1). In addition, when the sheet feeding cassette 17 is pulled out of the cassette housing part 15, the coupling gear 37*b* is separated from the driving gear and the meshing is released, so that the lift plate 33 is moved to the lowered position by its own weight and the weight of the placed sheets.

As shown in FIG. 3B, the lift plate 33 has a locked piece 49 at the downstream end portion of the lift plate 33 in the attachment direction X. The locked piece 49 is formed between two slits formed along the opposite direction to the attachment direction X with a space in the width direction from the downstream end edge of the attachment direction X. The locked piece 49 is formed by bending the portion between the two slits downward and then bending in the attachment direction X. A predetermined space is provided between the locked piece 49 and the lift plate 33 in the upper-and-lower direction.

Figure 4:
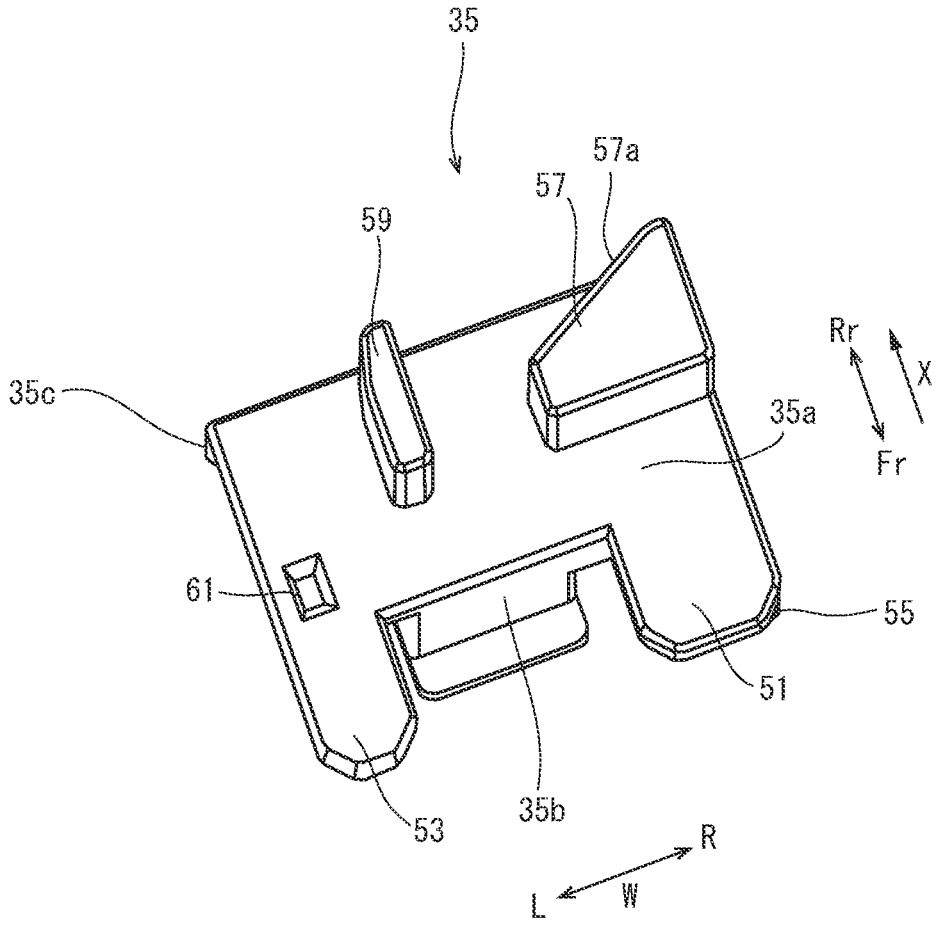
FIG. 4 is a perspective view showing a lock member of the sheet feeding cassette provided in the image forming apparatus according to the embodiment of the present disclosure.

Next, the lock member 35 will be described with reference to FIG. 4 and FIG. 5A and FIG. 5B. FIG. 4 is a perspective view showing the lock member 35, and FIG. 5A and FIG. 5B are perspective views showing the lock member 35 mounted on the cassette main body 31.

As shown in FIG. 4, the lock member 35 is a channel-shaped member with the lower surface opened, and has a rectangular upper plate 35*a* and front and rear side plates 35*b*, 35*c* bent downward from the front and rear sides of the upper plate 35*a*. The front side plate 35*b* is L-shaped when viewed from the left side. On both sides of the front side plate 35*b*, two lock pieces 51, 53 extending from the upper plate 35*a* forward (opposite to the attachment direction X) are formed. The thickness of the two lock pieces 51, 53 is thinner than the space between the lift plate 33 and the locked piece 49. Both corners of the two lock pieces 51 and 53 are chamfered linearly. In this example, the right lock piece in FIG. 4 is the first lock piece 51 and the left lock piece is the second lock piece 53. The first lock piece 51 has a hook piece 55 bent downward from the right edge. The hook piece 55 has the same length as the thickness of the locked piece 49 of the lift plate 33.

On the upper surface of the upper plate 35*a*, two protrusions 57, 59 are formed with a predetermined interval in the width direction W. In this example, the right protrusion is the first protrusion 57 and the left protrusion is the second protrusion 59. The first protrusion 57 has an approximately parallelopiped shape, and the rear surface 57*a* is inclined along the width direction W. In detail, the rear surface 57*a* is inclined forward from the right side to the left side. The first protrusion 57 is arranged side by side with the first lock piece 51 along the attachment direction X. The second protrusion 59 has a parallelopiped shape long in the attachment direction X. The second protrusion 59 is arranged on the right side of the second lock piece 53. In addition, the upper plate 35*a* has a hook hole 61 on the left side of the second protrusion 59. A downward-extending handle 63 (see FIG. 5B) is formed on the lower surface of the upper plate 35*a*. The handle 63 is wider than the guide slit 41.

Figure 5A:
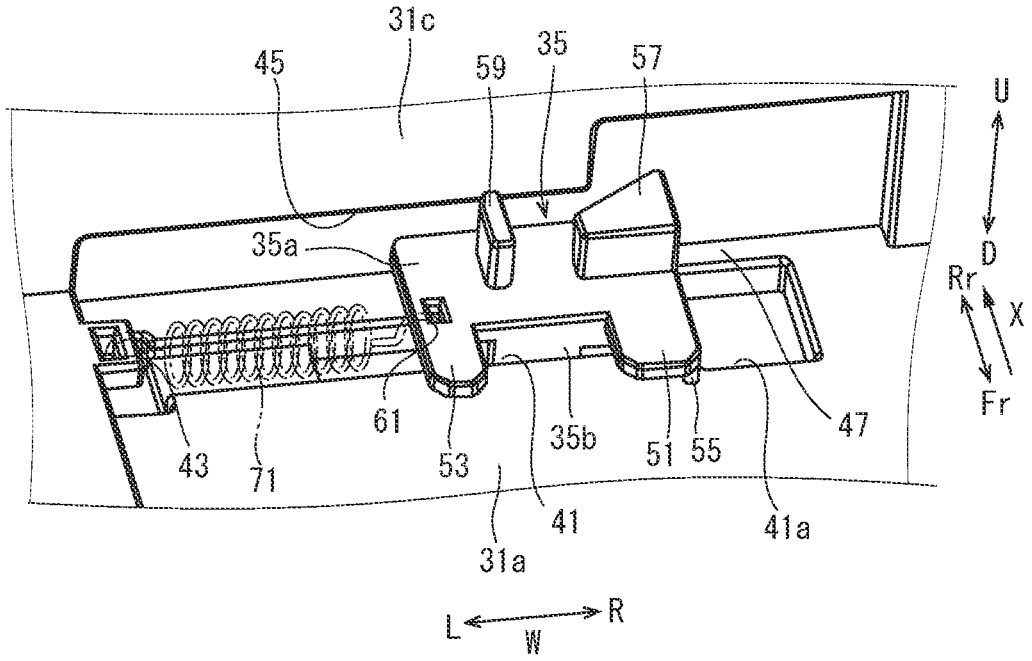
FIG. 5A is a perspective view showing the lock member mounted on the cassette main body, viewed from the upper side, in the sheet feeding cassette provided in the image forming apparatus according to the embodiment of the present disclosure.
Figure 5B:
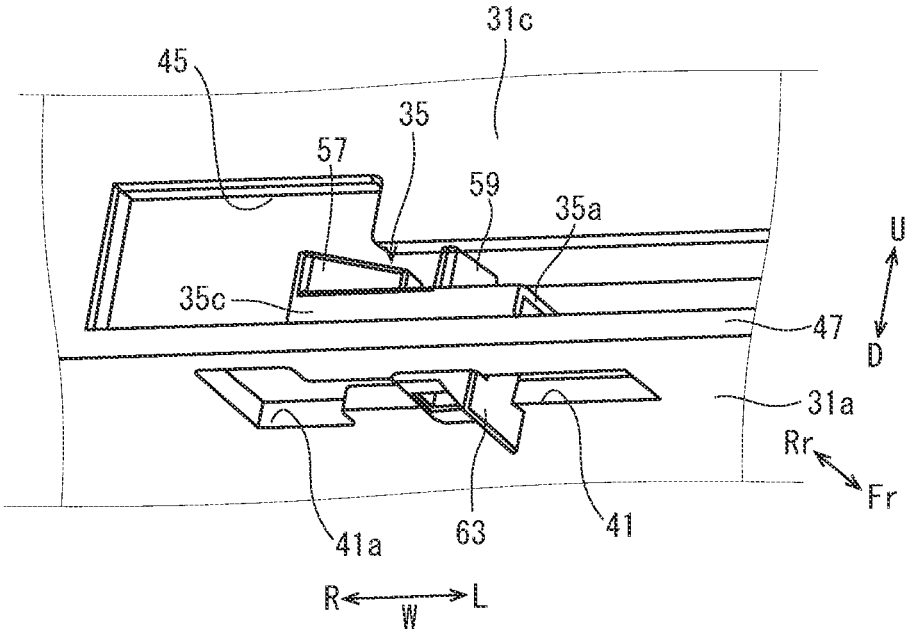
FIG. 5B is a perspective view showing the lock member mounted on the cassette main body, viewed from the lower side, in the sheet feeding cassette provided in the image forming apparatus according to the embodiment of the present disclosure.

As shown in FIG. 5A and FIG. 5B, the lock member 35 is set in a posture in which the first lock piece 51 and the second lock piece 53 face the upstream side of the attachment direction X, and the front and rear side plates 35*b*, 35*c* are inserted into the guide slit 41 and the opening 45 so as to straddle the rail part 47 of the cassette main body 31. The upper plate 35*a* is placed on the rail part 47, and the first lock piece 51 and the second lock piece 53 are placed on the bottom plate 31*a* of the cassette main body 31 on the front side of the guide slit 41. The first protrusion 57 and the second protrusion 59 are arranged between the lift plate 33 and the rear side plate 31*c* of the cassette main body 31.

Also, as shown in FIG. 5B, the handle 63 is exposed downward from the guide slit 41 of the bottom plate 31*a* and the lower opening of the cassette housing part 15. That is, the handle 63 is exposed from the lower surface of the image forming apparatus 1. Since the width of the handle 63 is wider than the width of the guide slit 41 as described above, the handle 63 is inserted into the guide slit 41 through the wide portion 41*a* of the guide slit 41.

The lock member 35 is movable in the width direction W along the rail part 47. When the lock member 35 is moved, the first lock piece 51 and the second lock piece 53 pass between the bottom plate 31*a* of the cassette main body 31 and the lift plate 33. The first protrusion 57 and the second protrusion 59 pass between the lift plate 33 and the rear side plate 35*c*.

As shown in FIG. 5A, a tension coil spring 71 is arranged between the hook 43 provided on the bottom plate 31*a* of the cassette main body 31 and the hook hole 61 of the lock member 35. The tension coil spring 71 biases the lock member 35 leftward.

Figure 6:
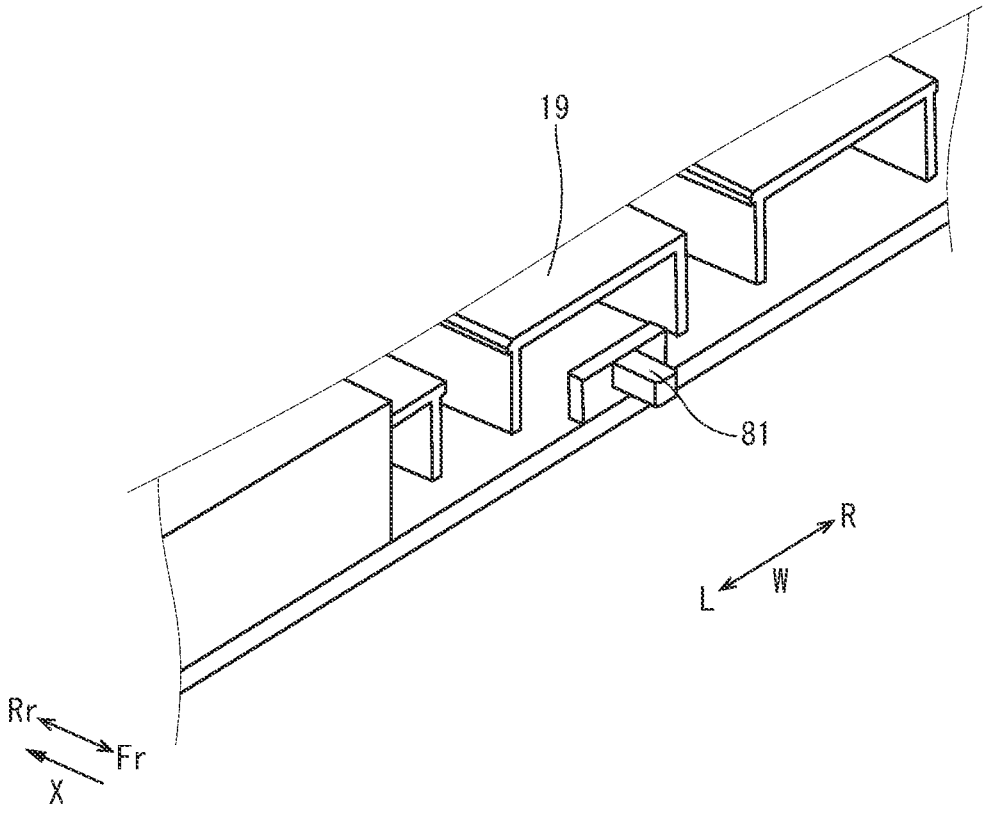
FIG. 6 is a perspective view showing an attachment part of a cassette housing part of the image forming apparatus according to the embodiment of the present disclosure.

Next, with reference to FIG. 6, the attachment part 19 of the sheet feeding cassette 17 will be described. FIG. 6 is a perspective view showing the attachment part 19. The attachment part 19 is provided with a pin 81 projecting in the direction opposite to the attachment direction X. The pin 81 is arranged to face the locked piece 49 of the lift plate 33 in the attachment direction X.

Figure 7A:
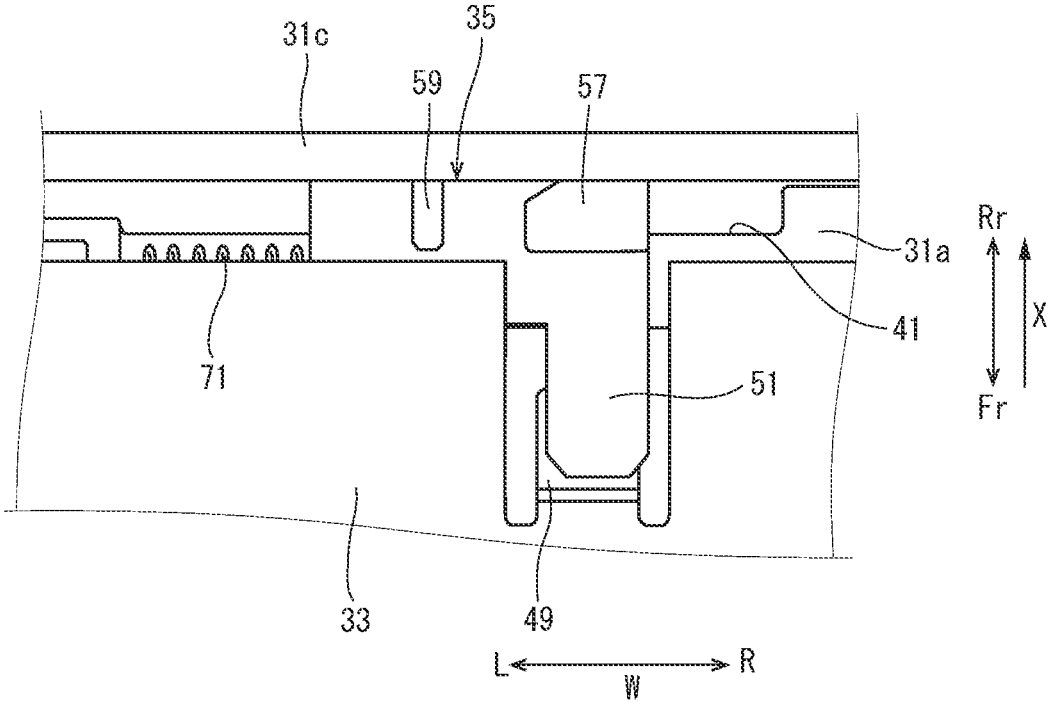
FIG. 7A is a plan view showing the lock member moved to a first lock position, in the sheet feeding cassette provided in the image forming apparatus according to the embodiment of the present disclosure.
Figure 7B:
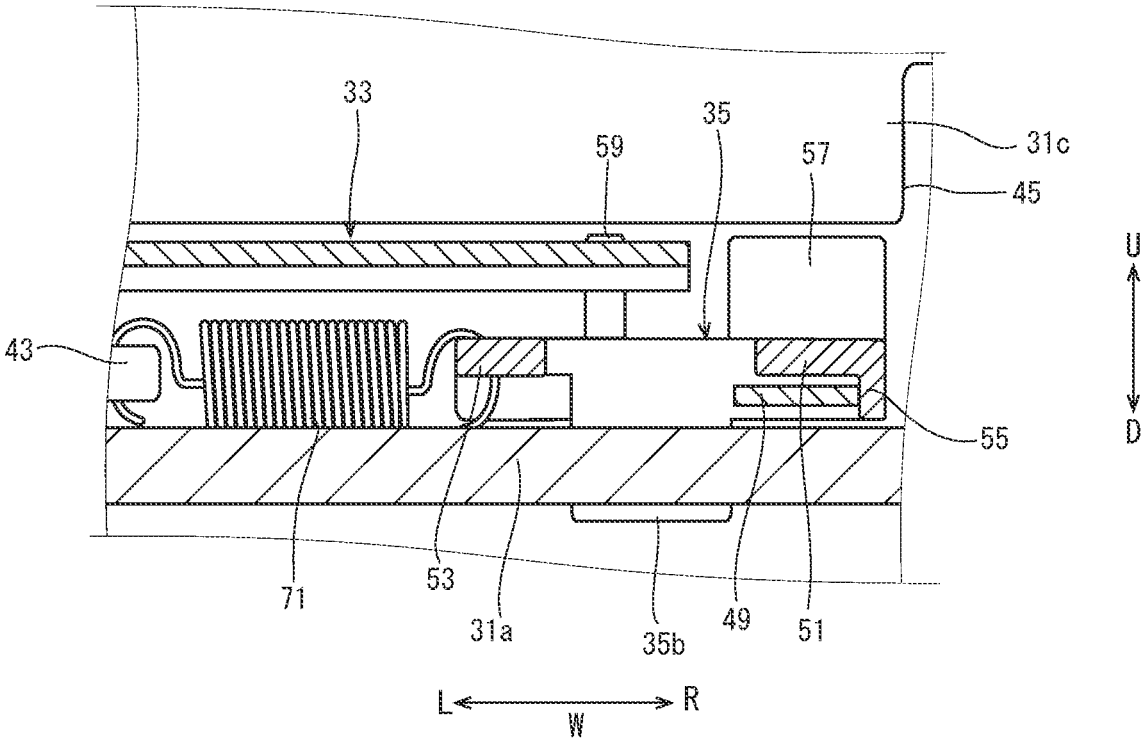
FIG. 7B is a cross-sectional view showing the lock member moved to the first lock position, in the sheet feeding cassette provided in the image forming apparatus according to the embodiment of the present disclosure.
Figure 8A:
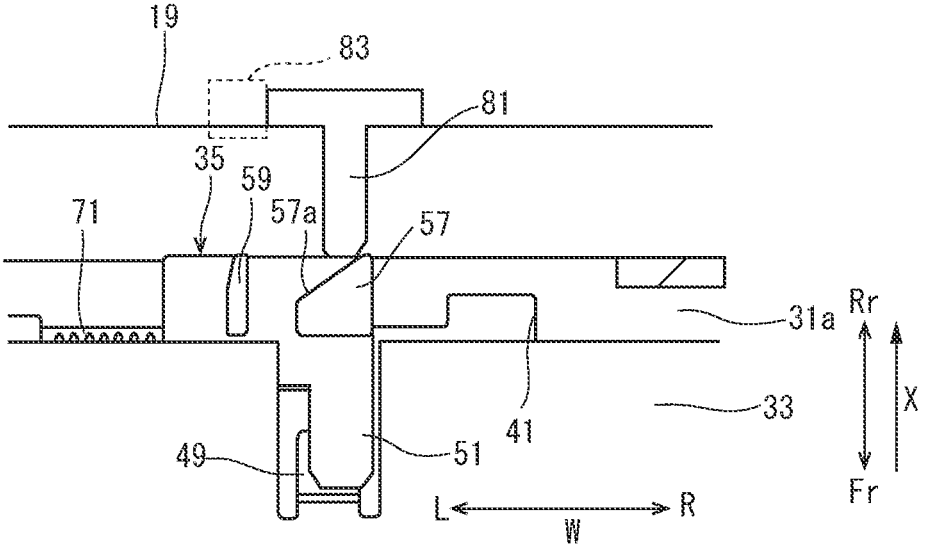
FIG. 8A is a plan view explaining a stage in which the lock member is moved to a release position, in the image forming apparatus according to the embodiment of the present disclosure.
Figure 8B:
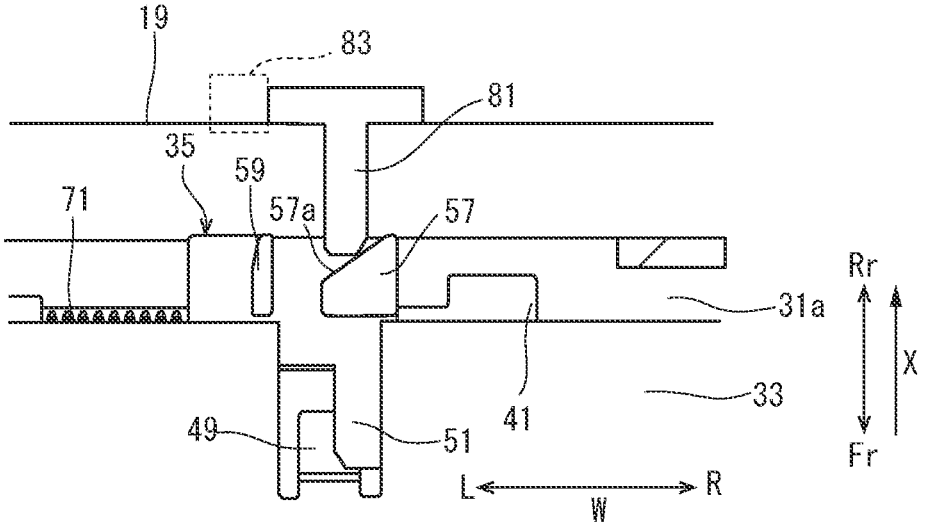
FIG. 8B is a plan view explaining the stage in which the lock member is moved to the release position, in the image forming apparatus according to the embodiment of the present disclosure.
Figure 8C:
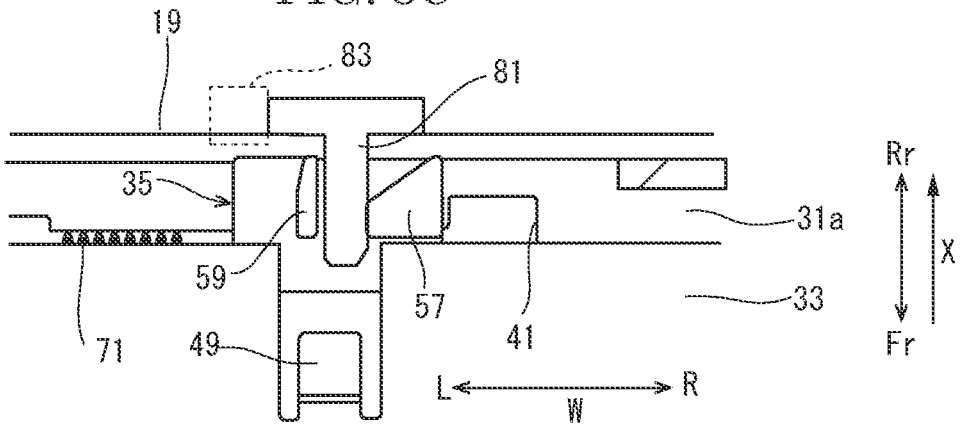
FIG. 8C is a plan view explaining the stage in which the lock member is moved to the release position, in the image forming apparatus according to the embodiment of the present disclosure.
Figure 9A:
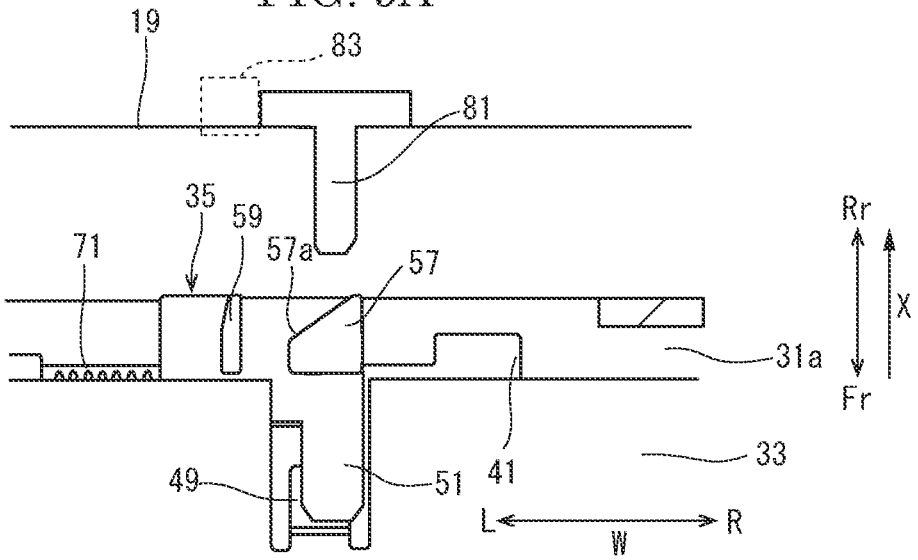
FIG. 9A is a plan view explaining a stage in which the lock member is moved to a second lock position, in the image forming apparatus according to the embodiment of the present disclosure.
Figure 9B:
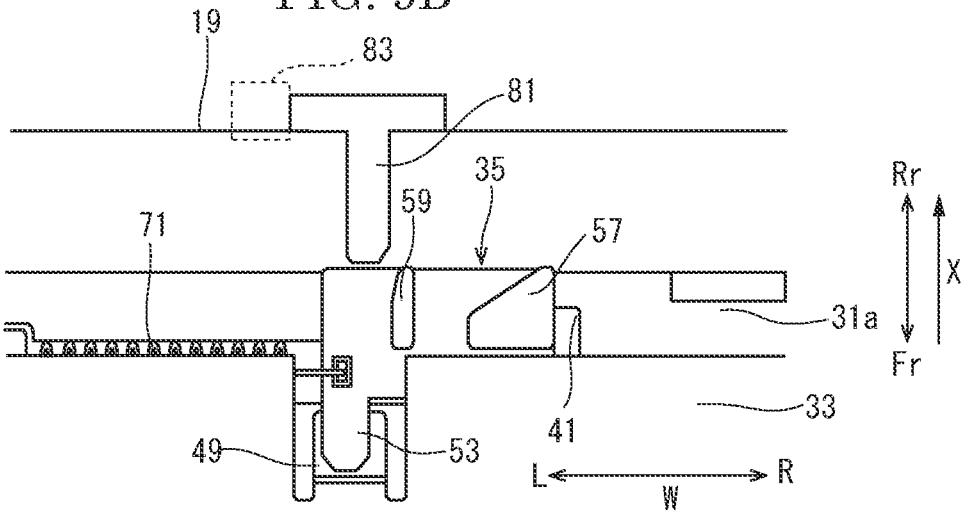
FIG. 9B is a plan view explaining the stage in which the lock member is moved to the second lock position, in the image forming apparatus according to the embodiment of the present disclosure.
Figure 9C:
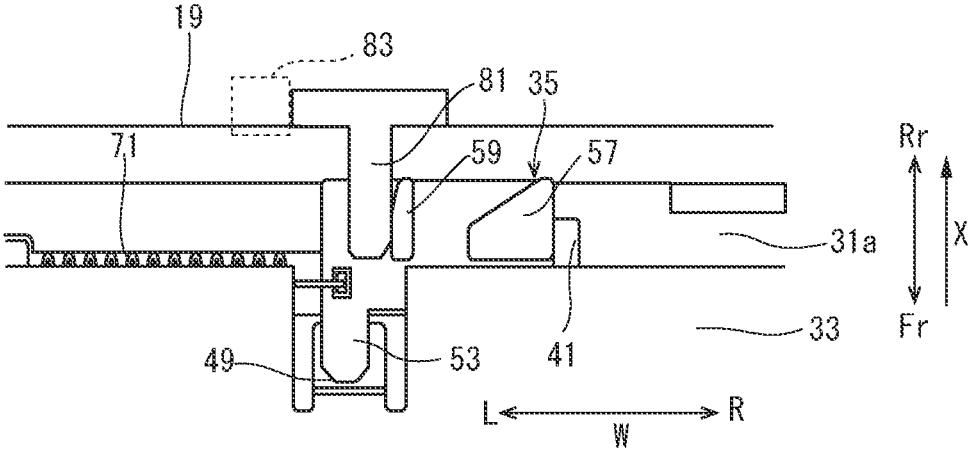
FIG. 9C is a plan view explaining the stage in which the lock member is moved to the second lock position, in the image forming apparatus according to the embodiment of the present disclosure.

The operation of restricting and permitting the turning of the lift plate 33 by the lock member 35 in the image forming apparatus 1 having the above configuration will be described with reference to FIG. 7A to FIG. 9C. FIGS. 7A and 7B are plan and sectional views showing the lock member 35 moved to the first lock position. FIG. 8A to FIG. 8C are plan views explaining the process of moving the lock member 35 to the release position. FIG. 9A to FIG. 9C are plan views explaining the process of moving the lock member 35 to the second lock position.

First, with reference to FIG. 7A and FIG. 7B, a state in which the sheet feeding cassette 17 with no stored sheets is not housed in the cassette housing part 15 will be described. For example, this state shows a case where the sheet feeding cassette 17 is handled by itself in order to replenish the sheets. In this case, the lift plate 33 is in contact with the bottom plate 31*a* of the cassette main body 31 due to its own weight. As shown in FIG. 7A, the first lock piece 51 is positioned above the locked piece 49 of the lift plate 33, so that the lock member 35 prevents the lift plate 33 from leaving the bottom plate 31*a*.

In a state where the sheet feeding cassette 17 is housed in the cassette housing part 15, the lock member 35 is held by the attachment part 19 in a position shifted rightward from the position shown in FIG. 7A, as described later. When the sheet feeding cassette 17 is pulled out of the cassette housing part 15, the meshing between the coupling gear 37*b* of the lift mechanism 37 and the driving gear is released, and the lift plate 33 is moved to the lowered position. Next, the lock member 35 is biased by the coil spring 71 to be moved leftward. The first lock piece 51 and the second lock piece 53 pass between the lift plate 33 and the locked piece 49. Eventually, as shown in FIG. 7B, the hook piece 55 of the first lock piece 51 abuts against the locked piece 49 of the lift plate 33, and the movement of the lock member 35 is stopped. With this, the first lock piece 51 moves above the locked piece 49. The position of the lock member 35 at this time is the first lock position. By moving the lock member 35 to the first lock position in this way, the turning of the locked piece 49, that is, the lift plate 33, is restricted. Thus, the coil spring 71 is an example of the biasing member that biases the lock member 35 to the lock position.

Next, with reference to FIG. 8A to FIG. 8C, a state in which the sheet feeding cassette 17 with the stored sheets is housed in the cassette housing part 15 and attached to the attachment part 19 will be described. This state enables the image forming operation to be performed. In this case, the sheets are stored in the cassette main body 31 of the sheet feeding cassette 17 under the state described above with reference to FIG. 7A and FIG. 7B. The downstream end portions of the sheets in the attachment direction X are placed on the lift plate 33. Thus, in this case, the turning of the lift plate 33 is restricted by the placed sheets. However, as described above, the lock member 35 is moved to the first lock position to restrict the turning of the lift plate 33.

As described above, the locked piece 49 of the lift plate 33 faces the pin 81 of the attachment part 19 in the attachment direction X, so as shown in FIG. 8A, as the sheet feeding cassette 17 with the stored sheets is inserted into the cassette housing part 15 along the attachment direction X, the pin 81 of the attachment part 19 faces the inclined rear surface 57*a* of the first protrusion 57 of the lock member 35. As the sheet feeding cassette 17 is further inserted, the pin 81 passes through the opening 45 of the rear side plate 31*c* of the cassette main body 31 and abuts on the inclined rear surface 57*a* of the first protrusion 57. As the sheet feeding cassette 17 is further inserted, the rear surface 57*a* of the first protrusion 57 is pushed by the pin 81, and the rear surface 57*a* is guided along the pin 81 as shown in FIG. 8B, and the lock member 35 begins to move rightward against the biasing force of the coil spring 71. That is, the first lock piece 51 begins to separate from the locked piece 49.

Then, when the sheet feeding cassette 17 is completely inserted into the cassette housing part 15 and attached to the attachment part 19, as shown in FIG. 8C, the pin 81 is separated leftward from the rear surface 57*a* of the first protrusion 57, and the first lock piece 51 is completely separated from the locked piece 49. This permits the turning of the lift plate 33. When the lift plate 33 is turned to the lifted position by the driving of the lift mechanism 37, the downstream end portions of the placed sheets in the attachment direction X is lifted, and the sheet can be fed by the sheet feeding device 21. The position of the lock member 35 at this time is defined as a release position. In addition, since the first protrusion 57 is locked by the pin 81, the lock member 35 is maintained in the release position against the biasing force of the coil spring 71.

When the sheet feeding cassette 17 is detached from the cassette housing part 15 in order to replenish the new sheets in the sheet feeding cassette 17, the first protrusion 57 is separated from the pin 81, and the lock member 35 is biased by the coil spring 71 to be moved leftward as described above. When the hook piece 55 of the first lock piece 51 abuts on the locked piece 49 of the lift plate 33, the lock member 35 is moved to the first lock position (see FIG. 8A). Therefore, the turning of the lift plate 33 is restricted during the replenishment operation.

Next, with reference to FIG. 9A to FIG. 9C, a state where the sheet feeding cassette 17 with no stored sheets is housed in the cassette housing part 15 and attached to the attachment part 19 at the time of shipment or transportation of the image forming apparatus.

In this case, the image forming apparatus 1 is previously shifted from the setting table so that the operator can operate the handle 63 of the lock member 35 exposed from the lower surface of the image forming apparatus 1. Then, the sheet feeding cassette 17 described above with reference to FIG. 7A and FIG. 7B is inserted into the cassette housing part 15 along the attachment direction X. As shown in FIG. 9A, the pin 81 of the attachment part 19 faces the rear surface 57*a* of the first protrusion 57 of the lock member 35.

Next, the operator holds the handle 63 (see FIG. 5B) exposed downward from the guide slit 41 of the cassette main body 31 of the sheet feeding cassette 17 and the lower opening of the cassette housing part 15 from the lower side of the image forming apparatus 1, and then moves the lock member 35 rightward against the biasing force of the coil spring 71. At this time, as shown in FIG. 9B, the lock member 35 is moved until the second lock piece 53 reaches above the locked piece 49 and the second protrusion 59 reaches the right side of the pin 81.

Then, the sheet feeding cassette 17 is inserted completely in the cassette housing part 15 and attached to the attachment part 19. Then, the pin 81 of the attachment part 19 enters the left side of the second protrusion 59. When the lock member 35 is released, the second protrusion 59 is locked by the pin 81, and the second lock piece 53 is moved above the locked piece 49. This restricts the turning of the lift plate 33. The position of the lock member 35 at this time is the second lock position. In addition, since the second protrusion 59 is locked by the pin 81, the lock member 35 is maintained in the second lock position against the biasing force of the coil spring 71.

Here, in FIG. 8A to FIG. 8C and FIG. 9A to FIG. 9C, an attachment detection part 83 provided in the attachment part 19 is shown by the dotted line. The attachment detection part 83 detects the attachment of the sheet feeding cassette 17. The attachment detection part 83 includes a reflective or transmissive optical sensor or a mechanical switch such as a microswitch and a tact switch. As shown in FIG. 8A to FIG. 8C, only when the sheet feeding cassette 17 is attached to the attachment part 19, the lock member 35 acts on the attachment detection part 83, and the attachment detection part 83 is switched from the cassette non-detection state to the cassette detection state. In the cassette non-detection state, even if the power of the image forming apparatus 1 is turned on, a preparation operation such as a warm-up operation and a printing processing are prohibited. Therefore, it is possible to prevent the image forming apparatus 1 from operating with the sheet feeding cassette 17 imperfectly attached and causing the defects. As shown in FIG. 9A to FIG. 9C, when the lock member 35 is in the second lock position, even if the sheet feeding cassette 17 is attached to the attachment part 19, the attachment detection part 83 is maintained in the cassette non-detection state because the lock member 35 does not act on the attachment detection part 83. Therefore, if the lift plate 33 is immovably held by the lock member 35, the turning of the lift plate 33 is prohibited even if the sheet feeding cassette 17 is attached to the attachment part 19 and the power is turned on.

Next, with reference to FIG. 10A and FIG. 10B, a modified example of the present invention will be described. In the modified example, the pin 81 provided in the attachment part 19 and the attachment detection part 83 are integrally provided so as to be movable in the width direction W. The pin 81 and the attachment detection part 83 can be manually moved to the first and second positions, which are one end side and the other end side in the width direction W.

Figure 10A:
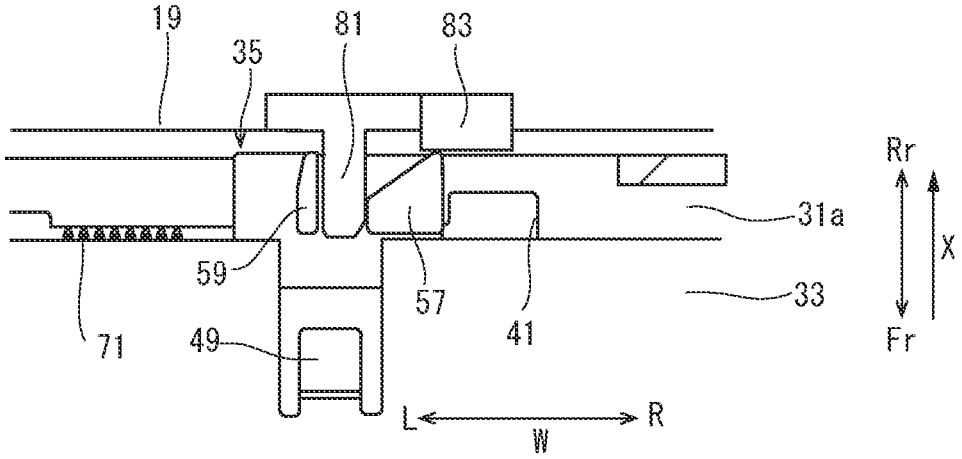
FIG. 10A is a plan view showing a pin positioned at a first position in the cassette housing part, in the image forming apparatus according to a modified example of the embodiment of the present disclosure.

FIG. 10A shows the case where pin 81 of the attachment part 19 is moved to the first position, which is the normal state of use of the image forming apparatus. In the first position, the pin 81 and the attachment detection part 83 face the lock member 35. When the sheet feeding cassette 17 is attached to the attachment part 19, the lock member 35 is moved rightward by the abutment of the pin 81 and the first protrusion 57, and the first lock piece 51 retreats from above the locked piece 49 to enable the lift plate 33 to be turned upward. The lock member 35 acts on the attachment detection part 83 to switch the attachment detection part 83 from the cassette non-detection state to the cassette detection state. This makes it possible to perform the preparation operation and printing processing while the power of the image forming apparatus 1 is turned on.

Figure 10B:
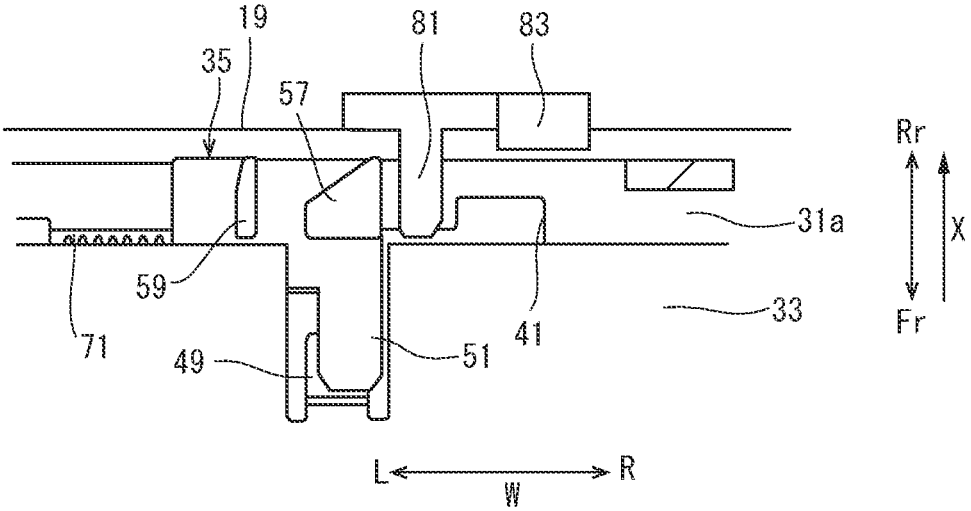
FIG. 10B is a plan view showing the pin positioned at a second position in the cassette housing part, in the image forming apparatus according to the modified example of the embodiment of the present disclosure.

FIG. 10B shows the case where pin 81 of the attachment part 19 is moved to the second position, which is the state in which the image forming apparatus is shipped or transported. In the second position, the pin 81 and the attachment detection part 83 are separated rightward in the width direction W with respect to the lock member 35. Even when the sheet feeding cassette 17 is attached to the attachment part 19, the first lock piece 51 is positioned above the locked piece 49 because the pin 81 does not act on the lock member 35, and the state where the upward turning of the lift plate 33 is restricted is maintained. In addition, the cassette non-detection state is maintained because the lock member 35 does not act on the attachment detection part 83. Thus, even when the power of the image forming apparatus 1 is turned on, the preparation operation and the printing processing are prohibited.

As is clear from the above description, according to the present invention, the turning of the lift plate 33 can be restricted without using an adhesive tape. That is, in the state where the sheet feeding cassette 17 with no stored sheet is not housed in the cassette housing part 15, and in the state where the sheet feeding cassette with no stored sheet is housed in the cassette housing part 15, the lock member 35 is moved to the first and second lock positions, respectively, so that the turning of the lift plate 33 can be restricted. Therefore, it is possible to prevent the generation of abnormal noise and the damage of members due to the turning of the lift plate 33 without using the adhesive tape or the like. On the other hand, when the sheet feeding cassette 17 with the stored sheets is housed in the cassette housing part 15, the lock member 35 is moved to the release position, so that the sheet feeding by the sheet feeding device 21 becomes possible.

When the sheet feeding cassette 17 with the stored sheets is housed in the cassette housing part 15 and attached to the attachment part 19, the lock member 35 is automatically moved to the release position by the pin 81. In addition, when the sheet feeding cassette 17 with no stored sheets is housed in the cassette housing part 15 and attached to the attachment part 19, the lock member 35 is moved by hand. In this way, the lock member 35 can be moved with relatively simple action.

The lock member 35 is movable in the width direction W, and is provided with the first lock piece 51 and the second lock piece 53 spaced apart in the width direction W. Therefore, even when the lock member 35 is moved in the width direction W according to the two states of the sheet feeding cassette 17, one state showing the state where the sheet feeding cassette 17 with the stored sheets is not housed in the cassette housing part 15 and the other state showing the state where the sheet feeding cassette with no stored sheets is housed in the cassette housing part 15, the turning of the lift plate 33 can be restricted by either the first lock piece 51 or the second lock piece 53.

Furthermore, the lock member 35 is provided with the first protrusion 57 and the second protrusion 59 spaced apart in the width direction W. Therefore, even when the lock member 35 is moved in the width direction W according to the two states of the sheet feeding cassette 17, one state showing the state where the sheet feeding cassette 17 with the stored sheets is attached to the attachment part 19 and the other state showing the state where the sheet feeding cassette 17 with no stored sheets is attached to the attachment part 19, the lock member 35 can be maintained in the release position and the second lock position by the first protrusion 57 and the second protrusion 59, respectively.

Although the invention has been described for a specific embodiment, the invention is not limited to the above embodiment. Those skilled in the art are able to modify the above embodiment if it does not deviate from the scope and spirit of the invention.

The invention claimed is:

1. An image forming apparatus comprising:

an attachment part; and a sheet feeding cassette which is attached to the attachment part in a predetermined attachment direction, wherein the attachment part includes a sheet feeding device which feeds a sheet from the sheet feeding cassette, and the sheet feeding cassette includes:

a cassette main body in which the sheet is stored;

a lift plate supported by the cassette main body in a turnable manner between a lowered position where the sheet can be placed and a lifted position where a downstream end portion of the placed sheet in the attachment direction can be fed by the sheet feeding device;

a lock member movable between a lock position where a turning of the lift plate with respect to the cassette main body is restricted and a release position where the turning of the lift plate is permitted; and a biasing member which biases the lock member to the lock position, wherein in a state where the sheet feeding cassette is not attached to the attachment part, the lock member is biased by the biasing member to be positioned at the lock position, and in a state where the sheet feeding cassette is attached to the attachment part, the lock member is movable either to the lock position or the release position by hand, the attachment part has a pin protruding in an opposite direction to the attachment direction, the lock member includes:

a first protrusion having a downward side surface in the attachment direction which is inclined along the width direction; and a second protrusion separated away from the first protrusion in the width direction, wherein in the state where the sheet feeding cassette is not attached to the attachment part, the lock member is biased by the biasing member to be moved to the first lock position, and in the state where the sheet feeding cassette is attached to the attachment part, the downstream side surface of the first protrusion is pushed by the pin to move the lock member to the release position, the first protrusion is locked by the pin so that the lock member is maintained in the release position, or the lock member is moved to the second lock position by hand and the second protrusion is locked by the pin so that the lock member is maintained in the second lock position.

2. The image forming apparatus according to claim 1, wherein the lock member is movable by hand from a lower side of an apparatus main body.

3. The image forming apparatus according to claim 1, wherein the lock member is movable in a width direction crossing the attachment direction, and has a first lock piece and a second lock piece separated from each other in the width direction, and the lock position contains a first lock position where the first lock piece restricts the turning of the lift plate and a second lock position where the second lock piece restricts the turning of the lift plate.

4. An image forming apparatus comprising:

an attachment part; and a sheet feeding cassette which is attached to the attachment part in a predetermined attachment direction, wherein the attachment part includes a sheet feeding device which feeds a sheet from the sheet feeding cassette, and the sheet feeding cassette includes:

a cassette main body in which the sheet is stored;

a lift plate supported by the cassette main body in a turnable manner between a lowered position where the sheet can be placed and a lifted position where a downstream end portion of the placed sheet in the attachment direction can be fed by the sheet feeding device;

a lock member movable between a lock position where a turning of the lift plate with respect to the cassette main body is restricted and a release position where the turning of the lift plate is permitted; and a biasing member which biases the lock member to the lock position, wherein in a state where the sheet feeding cassette is not attached to the attachment part, the lock member is biased by the biasing member to be positioned at the lock position, and in a state where the sheet feeding cassette is attached to the attachment part, the lock member is movable either to the lock position or the release position by hand, the attachment part has a pin protruding in an opposite direction to the attachment direction, and the pin is movable to a first position where the lock member is positioned in the release position in the state where the sheet feeding cassette is attached to the attachment part and a second position where the lock member is positioned in the lock position in the state where the sheet feeding cassette is attached to the attachment part.

5. An image forming apparatus comprising:

an attachment part; and a sheet feeding cassette which is attached to the attachment part in a predetermined attachment direction, wherein the attachment part includes a sheet feeding device which feeds a sheet from the sheet feeding cassette, and the sheet feeding cassette includes:

a cassette main body in which the sheet is stored;

a lift plate supported by the cassette main body in a turnable manner between a lowered position where the sheet can be placed and a lifted position where a downstream end portion of the placed sheet in the attachment direction can be fed by the sheet feeding device;

a lock member movable between a lock position where a turning of the lift plate with respect to the cassette main body is restricted and a release position where the turning of the lift plate is permitted; and a biasing member which biases the lock member to the lock position, wherein in a state where the sheet feeding cassette is not attached to the attachment part, the lock member is biased by the biasing member to be positioned at the lock position, and in a state where the sheet feeding cassette is attached to the attachment part, the lock member is movable either to the lock position or the release position by hand, the attachment part includes an attachment detection part switchable from a cassette non-detection state to a cassette detection state by an attachment of the sheet feeding cassette to the attachment part, and when the sheet feeding cassette is attached to the attachment part, the lock member acts on the attachment detection part to switch the attachment detection part from the cassette non-detection state to the cassette detection state.

* * * * *